US007338227B2

(12) United States Patent
Bullivant

(10) Patent No.: US 7,338,227 B2
(45) Date of Patent: Mar. 4, 2008

(54) ROLLER APPLICATOR FOR TOUCH-UP SYSTEM

(76) Inventor: Todd J. Bullivant, 58 Martin Dr., Lincroft, NJ (US) 07738

( * ) Notice: Subject to any disclaimer, the term of this patent is extended or adjusted under 35 U.S.C. 154(b) by 0 days.

(21) Appl. No.: 11/436,812

(22) Filed: May 18, 2006

(65) Prior Publication Data

US 2007/0048068 A1 Mar. 1, 2007

Related U.S. Application Data

(60) Provisional application No. 60/712,267, filed on Aug. 29, 2005.

(51) Int. Cl.
*B43M 11/02* (2006.01)

(52) U.S. Cl. ..... 401/220; 401/208; 401/218; 401/21

(58) Field of Classification Search ..... 401/208–220, 401/147, 21, 197; 132/317; 222/191, 192
See application file for complete search history.

(56) References Cited

U.S. PATENT DOCUMENTS 2,229,707 A * 1/1941 Testi ..... 401/219
3,076,995 A * 2/1963 Rabelow ..... 401/197
4,150,904 A * 4/1979 Stewart ..... 401/219
4,167,349 A * 9/1979 Testa ..... 401/208
4,952,090 A * 8/1990 Richardson ..... 401/219
5,915,872 A * 6/1999 Machida et al. ..... 401/214
5,957,609 A * 9/1999 Morita et al. ..... 401/214
6,045,283 A * 4/2000 Velasquez et al. ..... 401/208

* cited by examiner

*Primary Examiner*—Khoa D. Huynh
(74) *Attorney, Agent, or Firm*—Robert M. Skolnik

(57) ABSTRACT

A touch up system for applying small quantities of single or multi-component liquids to small surface areas. Each material or component is packaged, in the correct proportion, in a fluorinated plastic bottle. A dense foam roller is attached to the base component bottle. One of the other bottles utilize a spout tip cap to puncture an inductive barrier seal that is present on the opening of the base component bottle. Exposure to all coating components is eliminated and waste is minimized since material remaining in the bottle is minimal and can be disposed of by conventional methods. An angled roller wiper surface and an angled liquid output surface are provided.

4 Claims, 2 Drawing Sheets

4
14
6
7
13
5
3
2
1
8

ROLLER APPLICATOR FOR TOUCH-UP SYSTEM

Applicant claims priority of U.S. Provisional Patent Application 60/712,267, filed Aug. 29, 2005.

FIELD OF THE INVENTION

The present invention is a roller applicator for a touch-up paint system intended to apply small quantities of two component coatings.

SUMMARY OF THE INVENTION AND DESCRIPTION OF RELATED ART

The present invention is mini disposable self-contained touch-up paint system for two component coatings.

Prior art related devices are described below.

| | |
|---|---|
| 1,599,669 | Mitchell |
| 2,229,707 | Testi |
| 2,667,867 | Petersen |
| 3,027,591 | Petersen |
| 4,150,904 | Stewart |
| D363,377 | Koptis |
| 6,053,650 | Bennett, et al. |
| 6,598,762 | McKune |

Mitchell discloses a roller suspended over the hole in the top of a mucilage bottle. The roller is spring loaded so that pressure by the roller on the bottle top opens a spring loaded valve to permit the liquid to flow. Testi suspends an applicator roller between two arms. A pressure actuated valve shown in FIG. 8 in its open position permits product from the tube to flow to the roller.

Petersen (867) pumps shaving cream from the container to the roller applicator through a nozzle 35. Petersen (591) shows a squeeze bottle with an applicator support frame attached to but not covering the bottle nozzle.

Stewart generally shows major structural elements similar to a portion of the invention; however, it does not show the sloped roller wiper surface and the adjacent fluid output hole. Koptis is of general interest. Bennett et al shows a roller applicator for touchup paint but the nozzle structure of FIG. 3 is different from the present invention. McKune is representative of prior art aerosol touch up applicators.

The present invention is used for touching up military finishes when aerosols are not permitted and/or environmental conditions do not allow for their use. Current methods involve mixing two component materials prior to application and then using a paint brush or paint roller to apply. A can, paint tray, or some other mixing and storage container are required. There is considerable waste since most all two component coatings have a pot life of 4-8 hours. Hazardous waste can include admixed material, trays, brushes and clean up materials. Furthermore, current application methods result in a finish that is not of the same quality as the original spray finish. Brushing leaves bristle marks and streaks and traditional rollers leave a texture that distinguishes the original factory spray finish from the area being touched up.

The present invention solves these problems using a small disposable plastic paint roller attached to a bottle which holds approximately 4 ounces of admixed material.

This bottle is sealed with an inductive foil liner and initially holds approximately 40 ml of the base or A component. Another smaller HDPE bottle, which has also received a surface modification treatment via the application of a fluorination process, contains approximately 20 ml of the catalyst or B component. The smaller B bottle also has an inductive foil seal and a separate spout tip cap. The spout tip cap is used to first puncture the B bottle seal and is then screwed to the B bottle. The spout tip cap is sized (3 mm wide) so that there is no back pressure when pressure is exerted on the walls of the bottle to expel the contents. The B bottle is then inverted and the spout tip is used to puncture the seal on the base bottle containing the A component. The smaller B bottle is squeezed to expel its contents into the A bottle. Once all material is squeezed out, the B bottle is discarded and the A bottle cap is placed back on the A bottle and the admixed contents are thoroughly shaken. A small 11 gram steel ball in the base bottle facilitates agitation of the admixed material and creates sufficient chemical shear so that a complete reaction takes place.

The amount of admixed material is such that only half of the 4 ounce bottle or approximately 3 inches of its height is filled with the material. The extra space in the bottle and the length of the bottle are significant to the mixing process. The material can flow back and forth within the bottle while the steel ball travels from end to end creating the required chemical shear. Once this mixing and manual hand shaking is complete, the contents of a third small bottle, equal in size to the B component bottle, is dispensed into the larger bottle which now contains the admixed material. This third bottle contains de-ionized water or a solvent/thinner depending on the material formulation and reduction requirements. Again, an inductive seal is pierced with a spout tip cap and the contents dispensed.

Once the material is thinned with the water and the bottle shaken thoroughly, a dense foam roller head is attached to the bottle containing the admixed material. By squeezing the bottle walls, admixed coating material is discharged through a 3-4 mm hole in the plastic frame holding the dense foam roller. To apply more material, the container walls are depressed until sufficient amounts of material are on the dense foam roller.

To aid in the uniform application of paint on the dense foam roller, a wiper surface formed at an angle of about 30° from the horizontal and is in constant contact with the surface of the dense foam roller to depress same. The paint is outputted onto the roller via a hole which is adjacent the dense foam roller surface and the upper end of the wiper surface. The hole is also formed in a plane at an angle of about 15° from the horizontal.

It is therefore an object of the invention to provide a touch up system that facilitates the application of small quantities of two component paints and coatings for touch up purposes.

It is another object of the invention to provide a disposable touch up system consisting of small specially treated bottles, that provide improved/greater permeation resistance than untreated bottles, and which contain small, specific quantities of each component.

It is another object of the invention to provide a means of creating sufficient shear within a bottle that will also be used to convey admixed coating material to a dense foam roller applicator.

It is another object of the invention to provide a touch up system that minimizes individual component waste and admixed material waste.

It is another object of the invention to provide a disposable touch up system that minimize and reduces human exposure to the components and the admixed material.

It is another object of the invention to provide a disposable touch up system that preserves the qualities and integrity of the individual coatings components until the time of use.

DETAILED DESCRIPTION OF THE PREFERRED EMBODIMENT

Figure 1:
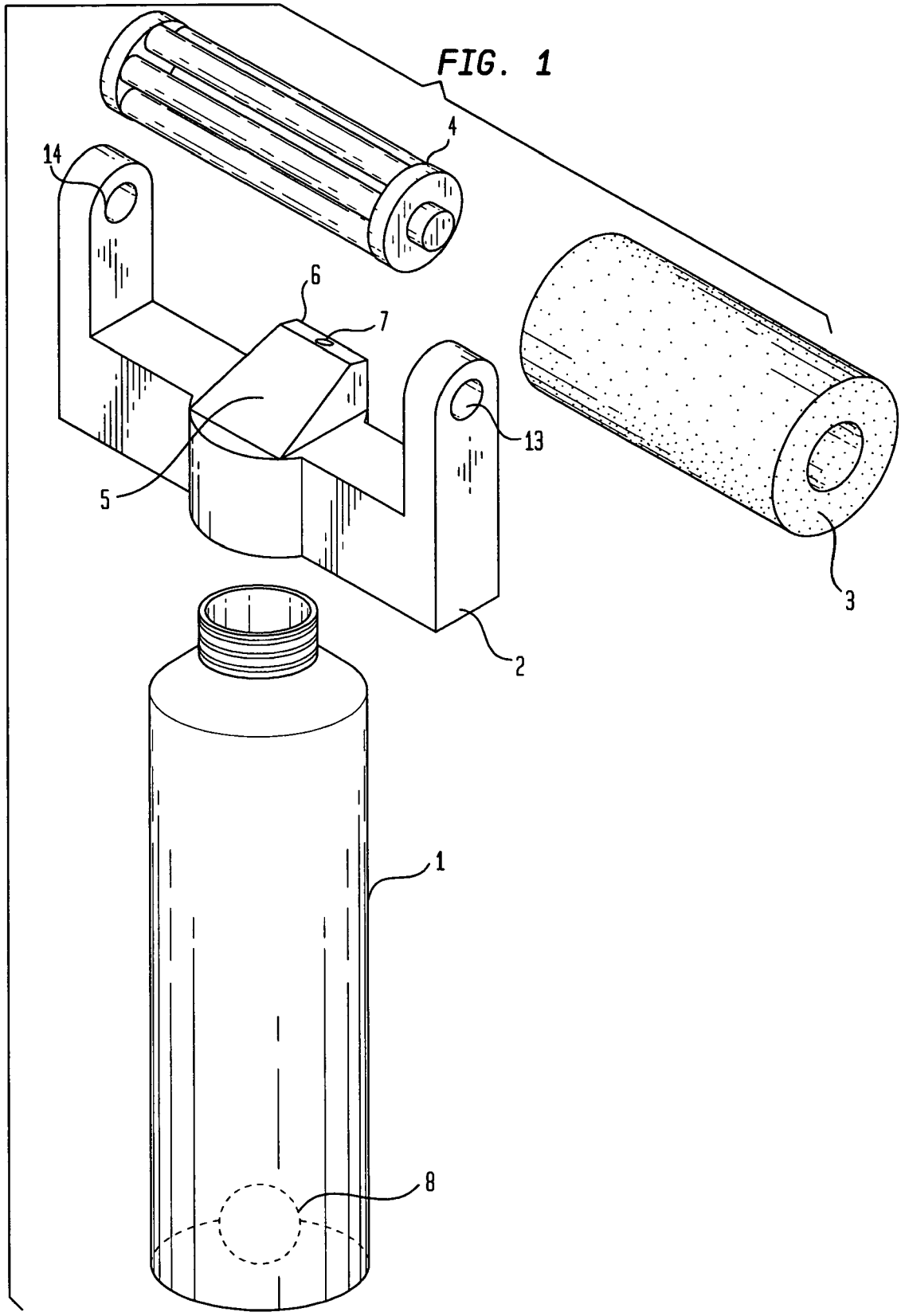
FIG. 1 is a perspective view of the assembly of a portion of the invention.
Figure 2:
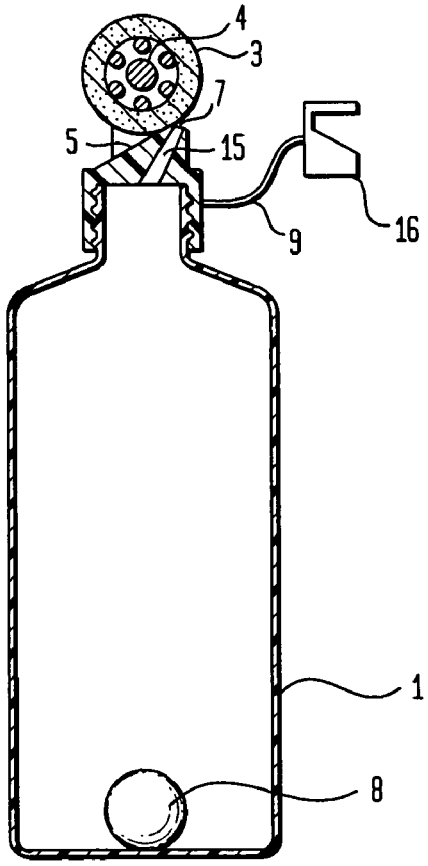
FIG. 2 is a sectional view of FIG. 1.

FIG. 1 is a perspective view of the roller applicator. As shown in FIGS. 1 and 2, bottle 1 has steel ball 8 located therein. The top of the bottle threadedly engages a dense foam roller applicator 3 support structure comprised of an open lattice foam support frame 4. The frame 4 is rotatably connected in the holes 13 and 14 in the arms of the attachment 2.

To aid in the uniform application of paint on the dense foam roller 3, a roller wiper surface 5 is formed at an angle of about 30° from the horizontal and is in constant contact with the surface of the dense foam roller 3 to depress same. The material from bottle 1 outputted onto the roller 3 via a hole 7 which is adjacent the dense foam roller 3 surface and the upper end of the wiper surface 5. The hole 7 is also formed in a planar surface 6 formed at an angle of about 15° from the horizontal.

A stopper 16 is coupled to attachment 2 via a flexible connector 9. The stopper 8 fits into hole 7 to close the hole as desired. The shaft 15 is formed at an angle through the top of the portion of the roller support that threadedly engages the top of bottle 8 to deliver the material.

Figure 3:
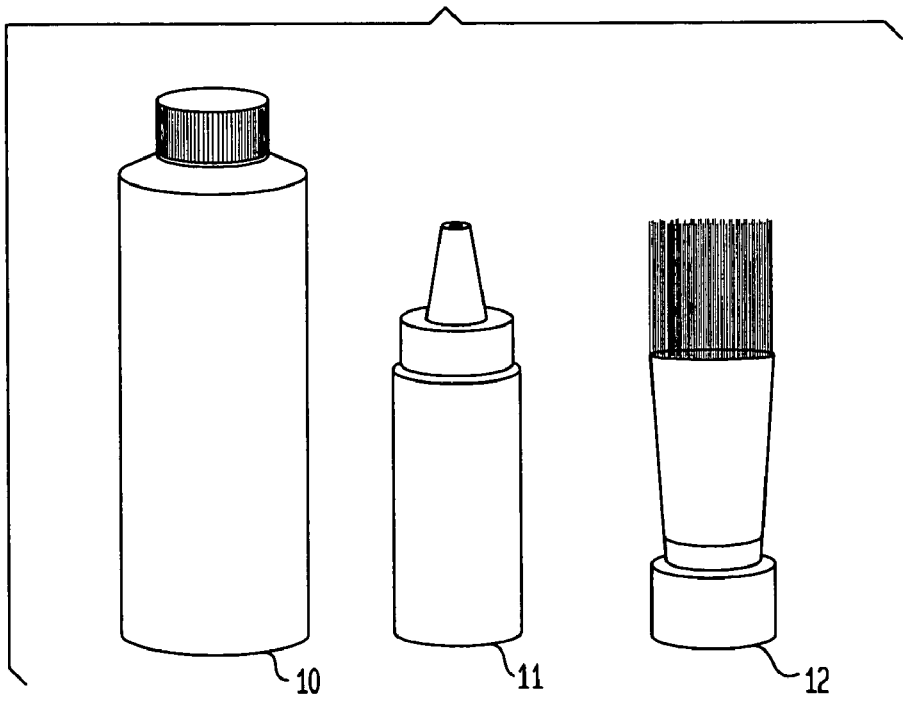
FIG. 3 is a perspective view of the other components of the inventive system.

FIG. 3 shows the other bottle components of the applicator system. Numeral 11 denotes the "B" bottle described above. Numeral 10 is the third bottle containing the deionized water. A brush attachment 12 is provided in the kit and may be used in place of the roller as required. Additional bottles for other additives may be provided as required.

Fluorination is a process whereby bottles are exposed to fluorine gas. There are 6 levels of fluorination treatments, levels 1-5 and a "super fluorination" or level 6. The bottles are placed in a chamber and the chamber is filled with fluorine gas. The fluorine gas changes the molecular structure of the plastic bottle. When a HDPE (High Density Poly Ethylene) plastic bottle is exposed to these gases, the surface is modified and it becomes less susceptible to permeation of paint and solvents OUT and less susceptible to air coming IN to the bottle. Thus, it better preserves the material and affords better storage stability and extends shelf life.

Further modifications to the methods and apparatus of the invention may be made without departing from the spirit and scope of the invention.

I claim:

1. A roller applicator system for applying liquid material to a surface comprising:

a first bottle having an opening;

a second bottle, said second bottle having a spout tip cap attached to said second bottle, said spout tip cap being sized so that there is no back pressure when pressure is exerted on the walls of said second bottle to expel the contents;

a steel ball disposed in said first bottle for ensuring agitation of said liquid material and for creating sufficient chemical shear so that a complete reaction takes place;

an attachment connected to said opening of said first bottle;

a dense foam roller applicator attached to said attachment via upwardly extending arms; said attachment having a roller wiper surface formed at a first angled plane having a first angle to aid in the uniform application of the liquid material onto said dense foam roller applicator, said first angled plane extends in a first direction, said roller wiper surface being in constant contact with the surface of said dense foam roller applicator at the upper end of said roller wiper surface to depress same;

a hole allowing the liquid material to flow from said first bottle onto said dense foam roller applicator, wherein said hole is formed in proximity to the surface of said dense foam roller applicator and adjacent the upper end of said roller wiper surface; wherein said hole is located in a second angled plane, said second angled plane connected to the upper end of said roller wiper surface and extended away from the upper end of said roller wiper surface in a second direction that opposites said first direction and formed a second angle which different from said first angle.

2. The roller applicator system of claim 1 further including a stopper flexibly attached to said first bottle for closing said hole.

3. A roller applicator system for applying liquid material to a surface comprising:

a first bottle having an opening;

a second bottle, said second bottle having a spout tip cap attached to said second bottle, said spout tip cap being sized so that there is no back pressure when pressure is exerted on the walls of said second bottle to expel the contents;

a steel ball disposed in said first bottle for ensuring agitation of said liquid material and for creating sufficient chemical shear so that a complete reaction takes place;

an attachment connected to said opening of said first bottle;

a dense foam roller applicator attached to said attachment via upwardly extending arms; said attachment having a roller wiper surface formed at a first angled plane having a first angle of about 30 degrees from the horizontal to aid in the uniform application of the liquid material onto said dense foam roller applicator, said first angled plane extends in a first direction, said roller wiper surface being in constant contact with the surface of said dense foam roller applicator at the upper end of said roller wiper surface to depress same;

a hole allowing the liquid material to flow from said first bottle onto said dense foam roller applicator, wherein said hole is formed in proximity to the surface of said dense foam roller applicator and adjacent the upper end of said roller wiper surface; wherein said hole is located in a second angled plane, said second angled plane connected to the upper end of said roller wiper surface and extended away from the upper end of said roller wiper surface in a second direction that opposites said first direction and formed a second angle of about 15 degrees with respect to the horizontal.

4. The roller applicator of claim 3 further including stopper means attached to said first bottle for closing said hole.

* * * * *